US010831134B2

(12) United States Patent
Karube

(10) Patent No.: US 10,831,134 B2
(45) Date of Patent: Nov. 10, 2020

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventor: Keiji Karube, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/015,966

(22) Filed: Jun. 22, 2018

(65) Prior Publication Data

US 2019/0004454 A1 Jan. 3, 2019

(30) Foreign Application Priority Data

Jun. 29, 2017 (JP) ..... 2017-127526

(51) Int. Cl.
*G03G 15/16* (2006.01)

(52) U.S. Cl.
CPC ... *G03G 15/162* (2013.01); *G03G 2215/1623* (2013.01)

(58) Field of Classification Search
None
See application file for complete search history.

(56) References Cited

U.S. PATENT DOCUMENTS

2004/0115544 A1* 6/2004 Fu ..... G03G 5/047 430/58.05
2010/0010148 A1* 1/2010 Imai ..... C09D 11/322 524/522
2010/0248105 A1* 9/2010 Nukada ..... G03G 5/14704 430/66
2013/0149540 A1 6/2013 Sato et al.
2014/0377564 A1 12/2014 Sakamoto et al.
2015/0323888 A1* 11/2015 Sakamoto ..... G03G 15/162 428/411.1

FOREIGN PATENT DOCUMENTS

JP 2009-192901 A 8/2009
JP 2015-121671 A 7/2015

* cited by examiner

*Primary Examiner* — Callie E Shosho
*Assistant Examiner* — Patrick N English
(74) *Attorney, Agent, or Firm* — Venable LLP

(57) ABSTRACT

The present disclosure provides an electrophotographic belt which contributes to stable formation of an electrophotographic image of high quality. The electrophotographic belt includes a base layer and a surface layer, wherein the surface layer contains a binder resin, a perfluoropolyether and a comb-shaped graft copolymer, the comb-shaped graft copolymer is a copolymer of an acrylate or methacrylate having a fluoroalkyl group and a methacrylate macromonomer having a polymethyl methacrylate as a side chain, the comb-shaped graft copolymer has a number average molecular weight of 11000 or higher and 15000 or lower, and the comb-shaped graft copolymer has a peak-top molecular weight of 24000 or higher and 40000 or lower.

9 Claims, 2 Drawing Sheets

ELECTROPHOTOGRAPHIC BELT AND ELECTROPHOTOGRAPHIC IMAGE FORMING APPARATUS

BACKGROUND OF THE INVENTION

Field of the Invention

The present disclosure relates to an electrophotographic belt to be used for electrophotographic image forming apparatuses such as copiers and printers, and an electrophotographic image forming apparatus.

Description of the Related Art

A tandem method is widely employed for electrophotographic image forming apparatuses, the method including overlaying toner images respectively having colors of YMCK on an intermediate transfer belt and then transferring the resultant onto a paper sheet in a lump.

A semiconductive belt is commonly used for such an intermediate transfer belt, and a belt formed through dispersing carbon black in a resin such as polyimide or polyamideimide is known as a representative example of the semiconductive belt.

In such circumstances, further improvement of transfer properties is required of intermediate transfer belts for electrophotographic apparatuses, of which higher speed and higher durability are required. As one strategy, improvement of transfer properties through subjecting the surface of an intermediate transfer belt to various types of processing has been attempted. Japanese Patent Application Laid-Open No. 2009-192901 proposes an intermediate transfer body having an enhanced transfer efficiency imparted through coating the surface with a fluorine compound having water-repellency and oil-repellency to reduce the adhesion force of a developer to the surface of the intermediate transfer body.

However, it is necessary for the intermediate transfer body the surface of which has been coated with a fluorine compound mentioned above to contain a certain quantity or more of a fluorine compound, in order to maintain the low adhesion of the surface to a developer for a long period of time. In relation to this requirement, the glossiness of the belt surface is lowered to lead to a poor accuracy in a patch test in some cases.

SUMMARY OF THE INVENTION

One aspect of the present disclosure is directed to providing an electrophotographic belt which contributes to stable formation of an electrophotographic image of high quality.

Another aspect of the present disclosure is directed to providing an electrophotographic image forming apparatus which can stably form an electrophotographic image of high quality.

According to one aspect of the present disclosure, there is provided an electrophotographic belt including a base layer and a surface layer, wherein the surface layer contains a binder resin, a perfluoropolyether and a comb-shaped graft copolymer, the comb-shaped graft copolymer is a copolymer of an acrylate or methacrylate having a fluoroalkyl group and a methacrylate macromonomer having a polymethyl methacrylate as a side chain, the comb-shaped graft copolymer has a number average molecular weight of 11000 or higher and 15000 or lower, and the comb-shaped graft copolymer has a peak-top molecular weight of 24000 or higher and 40000 or lower.

According to another aspect of the present disclosure, there is provided an electrophotographic belt including a base layer and a surface layer, wherein the surface layer containing a binder resin and a perfluoropolyether, and the surface layer has, in the thickness direction, a matrix-domain structure, and the average major axis of the domain is 1 nm or larger and 60 nm or smaller.

According to still another aspect of the present disclosure, there is provided an electrophotographic image forming apparatus including the electrophotographic belt.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

Now, exemplary embodiments of the present disclosure will be described in detail with reference to the drawings. However, the dimensions, material and shape of components described in embodiments below, and the relative positions, etc., of components should be appropriately modified according to the configuration of and conditions for an apparatus to which the present disclosure is applied, and it is not intended to limit the scope of the present disclosure only thereto.

[Schematic and Operation of Image Forming Apparatus]

Figure 1:
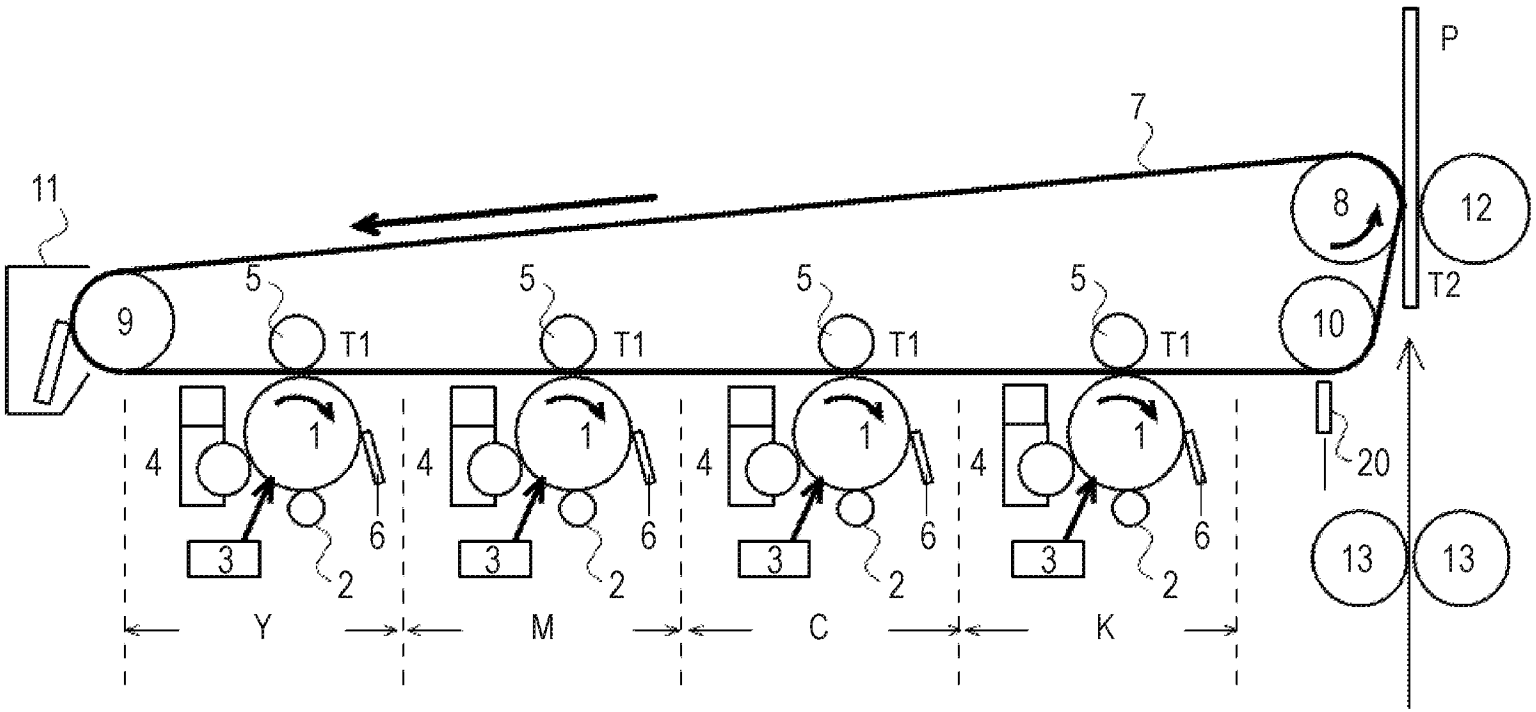
FIG. 1 is a cross-sectional view illustrating one example of an image forming apparatus using the electrophotographic belt according to the present disclosure.

FIG. 1 is a schematic cross-sectional view of an electrophotographic image forming apparatus including the electrophotographic belt according to one aspect of the implementation as an intermediate transfer belt.

As illustrated in FIG. 1, the configuration of the image forming apparatus is as follows: the image forming apparatus includes four process units each as an image forming unit configured with a charging unit, an exposure unit, a developing unit, a cleaner and so on disposed around a photosensitive drum as an image carrier; images on the photosensitive drums formed by the process units are sequentially transferred multiply to an intermediate transfer belt located adjacent to the photosensitive drums and moving and passing through a plurality of primary transfer sections, and as a result a full-color toner image is formed; thereafter, the toner image formed on the intermediate transfer belt is transferred onto a recording material in a lump in a secondary transfer section; and the toner image on the recording material is thereafter immobilized through fusing by heat or pressure and fixed onto the recording material in a fixing section.

Now, the electrophotographic image forming apparatus will be described in detail.

This image forming apparatus includes four image forming units, namely, first to fourth image forming units Y, M, C and K disposed in parallel form the left side to right side in the drawing. The image forming units Y, M, C and K are identical in configuration, and each of the image forming units Y, M, C and K has a mechanism of an electrophotographic process based on laser scanning exposure, and includes an electrophotographic photoconductor drum (hereinafter, abbreviated as "drum") 1 as an image carrier. In addition, each of the image forming units Y, M, C and K includes a charging roller 2 as a charging unit, an exposure device 3 as an exposure unit, a developing device 4 as a developing unit, a primary transfer roller 5 as a primary transfer unit, a drum cleaner 6 and so on, each of which is an electrophotographic process unit to act on the drum 1.

The intermediate transfer belt 7 is held in a tensioned state on three rollers positioned inside of the belt in parallel, namely, a secondary transfer opposing roller 8, which also serves as a driving roller, a deviation correction roller 9, which also serves as a tension roller, and a driven roller 10. The deviation correction roller 9 is disposed in the first image forming unit Y side, the secondary transfer opposing roller 8 is disposed in the fourth image forming unit K side, and the driven roller 10 is disposed at a position under the secondary transfer roller 8. The lower surface of the intermediate transfer belt between the deviation correction roller 9 and the driven roller 10 is contacted with the upper surfaces of the drums 1 of the image forming units Y, M, C and K. The deviation correction roller 9 is capable of controlling the deviation of the intermediate transfer belt through alignment adjustment.

The primary transfer rollers 5 in the image forming units Y, M, C and K are disposed in the inner side of the intermediate transfer belt between the deviation correction roller 9 and the driven roller 10, and each of the primary transfer rollers 5 is pressed to contact with the upper surface of the drum 1 with the intermediate transfer belt 7 sandwiched therebetween. A contacting portion between each of the drums 1 of the image forming units Y, M, C and K and the intermediate transfer belt 7 is a primary transfer nip portion T1. A contacting portion between the intermediate transfer belt 7 and the secondary transfer roller 12 is a secondary transfer nip portion T2. In the upstream of the secondary transfer nip portion T2 in the conveyance direction for a recording material, a pair of registration rollers 13 is disposed. In the downstream of the secondary transfer nip portion T2 in the conveyance direction for a recording material, a recording material-conveying belt device and a fixing device, which are not illustrated, are sequentially disposed.

Operation to form a full-color image is as follows: the first to fourth image forming units Y, M, C and K are driven at a given point of time for control in an image formation sequence; as a result of the driving thereof, the drums 1 are rotationally driven at a given speed identical to the speeds of image forming units Y, M, C and K in the clockwise direction indicated by an arrow; and the intermediate transfer belt 7 is also rotated by the secondary transfer roller 8 at the same speed as that of the drums 1 in the counterclockwise direction indicated by an arrow.

The surfaces of the drums 1 are uniformly charged to a given polarity and potential by the charging rollers 2. The charged surfaces of the drums 1 are subjected to imaging exposure through the exposure devices 3. In the present embodiment, the exposure devices 3 are each a laser scanner, and each output a laser beam modified according to image information signals to perform scanning exposure for the charged surfaces of the drums 1. As a result, electrostatic images (electrostatic latent images) corresponding to the scanning exposure patterns are formed on the drum surfaces. The electrostatic images formed are developed as toner images by the developing devices 4.

Through the above-described electrophotographic process, in the first image forming unit Y, a yellow toner image corresponding to the image of the yellow component among the images of the color separation components for the full-color original image is formed on the surface of the drum 1. A magenta toner image corresponding to the image of the magenta component and a cyan toner image corresponding to the image of the cyan component are formed in the second image forming unit M and in the third image forming unit C, respectively, at a given point of time for control. A black toner image corresponding to the image of the black component is formed in the fourth image forming unit K at a given point of time for control.

At the primary transfer nip portion T1 of the first image forming unit Y, a yellow toner image to be formed on the drum 1 is primary-transferred onto the intermediate transfer belt 7 rotationally driven. At the primary transfer nip portion T1 of the second image forming unit M, subsequently, a magenta toner image to be formed on the drum 1 is primary-transferred onto the yellow toner image on the intermediate transfer belt 7 in an overlapping manner. Further, in the same manner, a cyan toner image and a black toner image are sequentially primary-transferred to the intermediate transfer belt 7 at the primary transfer nip portions T1 in the third image forming unit C and in the fourth image forming unit K, respectively.

In other words, color toner images of four colors, in this case, yellow, magenta, cyan and black are appropriately sequentially overlapped and transferred in a superimposed manner (multiply) to form an unfixed full-color, combined toner image. Primary transfer from the drum 1 to the intermediate transfer belt 7 at each primary transfer nip portion T1 is as follows: a given primary transfer bias is applied to the primary transfer roller 5 by a primary transfer power source section, which is not illustrated, and a toner image is electrostatically transferred from the drum 1 to the intermediate transfer belt 7 to achieve primary transfer.

The primary transfer bias has a polarity reverse to the polarity of the charge of the toner, and a DC voltage at a given potential. The surface of the drum 1 in each of the image forming sections Y, M, C and K after passing through the primary transfer nip portion is cleaned through removal of toner residues after primary transfer by the drum cleaner 6, and repeatedly used for image formation.

The unfixed full-color, combined toner image formed on the intermediate transfer belt 7 as described above is conveyed via the continuing rotation of the intermediate transfer belt 7, and arrives at the secondary transfer nip portion T2 as a contacting portion between the secondary transfer roller 12 and the intermediate transfer belt 7.

At a point of time when the end of the unfixed full-color toner image formed on the intermediate transfer belt 7 arrives at the secondary transfer nip portion T2, the rotation of the pair of registration rollers 13 is initiated in a manner such that the starting position for printing in a recording material P corresponds to the secondary transfer nip portion T2. During the recording material P is conveyed while being sandwiched at the secondary transfer nip portion T2, a secondary transfer bias having a polarity reverse to the polarity of the charge of the toner at a given potential is applied to the secondary transfer roller 12 by a secondary transfer power source section. The secondary transfer bias has a polarity reverse to the polarity of the charge of the toner, and a DC voltage at a given potential.

As a result, the unfixed full-color toner image on the intermediate transfer belt 7 is secondary-transferred in a lump onto the recording material P. The recording material P which has exited the secondary transfer nip portion T2 is separated from the intermediate transfer belt 7, and introduced to the fixing device via the recording material-conveying belt device. In the fixing device, the toners in the toner images of different colors are fused and the colors are mixed together, and the toners are fixed as a full-color printed image (formed as an immobilized image) on the surface of the recording material. Thus, a full-color print is discharged out of the apparatus.

The surface of the intermediate transfer belt 7 after separation of the recording material P is cleaned by an intermediate transfer belt cleaner 11 through removal of residual toners after secondary transfer during the continuing rotation of the intermediate transfer belt 7, and thus conditioned for the subsequent image formation process.

In the intermediate transfer belt cleaner 11, a cleaning blade is contacted with the surface of the belt 7 to scrape residual toners attaching to the belt surface after secondary transfer, and the scraped toners are recovered as recovered toners in a recovered toner box in the intermediate transfer belt cleaner 11.

A patch detection sensor 20 (toner image detection unit) having a function to detect image concentration is provided at a position opposing to the intermediate transfer belt section held in a tensioned state by the driven roller 10. The patch detection sensor 20 is a sensor to optically detect reflected light and scattered light of light with which a toner image for adjustment (patch image) formed on the intermediate transfer belt was irradiated.

During a period not included in the period in which toner images to be subjected to secondary transfer onto the recording material P are primary-transferred, a toner image for adjustment (patch image) is formed on the intermediate transfer belt. The image formation conditions are adjusted according to the results.

To stably and accurately perform concentration measurement for control of the image formation conditions, the intensity of reflected light from the surface of the intermediate transfer belt can be in a certain level or higher. The concentration of a patch image can be more accurately detected through reliably detecting reflected light from the surface of the intermediate transfer belt, and as a result generation of unevenness in concentration among images can be prevented. Now, the intermediate transfer belt 7 included in the image forming apparatus will be described in detail.

[Electrophotographic Belt]

<Base Layer>

Figure 2:
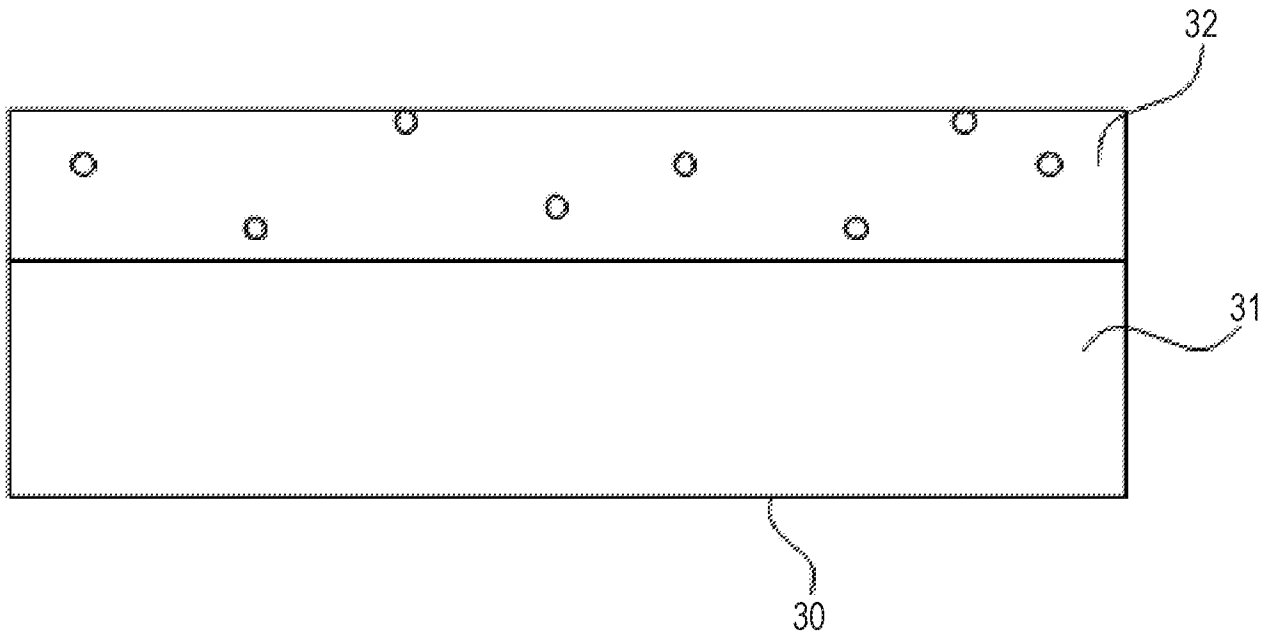
FIG. 2 is a diagram schematically illustrating a cross-section of the electrophotographic belt according to the present disclosure.

As illustrated in FIG. 2, an electrophotographic belt 30 includes two layers consisting of a base layer 31 and a surface layer 32 provided on the outer periphery of the base layer 31.

The material constituting the base layer 31 can be a resin having mechanical strength and bending resistance required for an electrophotographic belt for an image forming apparatus.

Specific examples of such resin are as follows:

polyamide, polyacetal, polyarylate, polycarbonate, polyphenylene ether, polyethylene terephthalate, polyethylene naphthalate, polybutylene naphthalate, polysulfone, polyether sulfone, polyphenyl sulfide, polybutylene terephthalate, polyether ether ketone, polyvinylidene fluoride, polyvinyl fluoride, polyether amide copolymer, polyurethane copolymer, polyimide and polyamideimide.

The base layer 31 can be formed from one of these resins or a mixture of these resins.

Typically, a conductive substance can be added to the base layer 31 to impart conductivity to the base layer 31. Examples of the conductive substance include inorganic conductive particles based on carbon such as carbon black, carbon fibers and carbon nanotubes, and inorganic conductive particles of metal oxide or the like such as zinc antimonate, zinc oxide, tin oxide and titanium oxide.

The volume resistivity of the base layer 31 can be adjusted in the range of 1E+8 [Ω·cm] or higher and 1E+12 [Ω·cm] or lower. Through setting the volume resistivity of the base layer 31 to 1E+12 [Ω·cm] or lower, degradation of primary transfer properties and secondary transfer properties due to application of a given transfer bias can be more reliably suppressed. Through setting the volume resistivity of the base layer 31 to 1E+8 [Ω·cm] or higher, generation of unevenness in resistance is suppressed, and generation of unevenness in transfer or the like and generation of image failure can be more reliably prevented.

The surface resistivity of the base layer 31 can be adjusted in the range of 1E+8 [Ω/□] or higher and 1E+14 [Ω/□] or lower.

Through setting the surface resistivity of the base layer 31 in the mentioned range, image failure due to peeling discharge and toner scattering when a toner-receiving material is separated from the electrophotographic belt can be more reliably reduced.

The thickness of the base layer 31 can be 40 μm or larger and 200 μm or smaller in view of mechanical strength and bending resistance.

<Surface Layer>

The surface layer 32 contains a binder resin, a perfluoropolyether (hereinafter, also referred to as "PFPE") and a comb-shaped graft copolymer (hereinafter, also referred to as "dispersant").

The comb-shaped graft copolymer is a copolymer of an acrylate or methacrylate having a fluoroalkyl group and a methacrylate macromonomer having a polymethyl methacrylate as a side chain, has a number average molecular weight of 11000 or higher and 15000 or lower, and has a peak-top molecular weight of 24000 or higher and 40000 or lower.

The surface layer 32 may contain a photopolymerization initiator, a conductive substance, etc., in addition to the binder resin, PFPE and dispersant.

<Binder Resin>

Styrenic resin, acrylic resin, methacrylic resin, epoxy resin, polyester resin, polyether resin, silicone resin or polyvinyl butyral resin, or a mixed resin thereof can be used for the binder resin.

The binder resin is used to disperse the PFPE, ensure adhesion to the base layer 31, and ensure properties of mechanical strength.

Among the above binder resins, methacrylic resin or acrylic resin can be suitably used because methacrylic resin and acrylic resin can satisfactorily disperse the PFPE constituting the surface layer 32 of the electrophotographic belt. Hereinafter, methacrylic resin and acrylic resin are collectively termed "acrylic resin".

Examples of polymerizable monomer to form acrylic resin include polymerizable monomers listed in (i) and (ii) below. Alternatively, polymerizable monomer commercially available as a coating material can be used.

(i) at least one acrylate selected from the group consisting of pentaerythritol triacrylate, pentaerythritol tetraacrylate, ditrimethylolpropane tetraacrylate, dipentaerythritol hexaacrylate, alkyl acrylate, benzyl acrylate, phenyl acrylate, ethylene glycol diacrylate and bisphenol A diacrylate.

(ii) at least one methacrylate selected from the group consisting of pentaerythritol trimethacrylate, pentaerythritol tetramethacrylate, ditrimethylolpropane tetramethacrylate, dipentaerythritol hexamethacrylate, alkyl methacrylate, benzyl methacrylate, phenyl methacrylate, ethylene glycol dimethacrylate and bisphenol A dimethacrylate.

Among these polymerizable monomers, polymerizable monomers having high hardness can be used in consideration of frictional sliding on another member such as a photoconductor and a cleaning blade. Accordingly, a large quantity of bifunctional or higher functional cross-linkable monomer can be used for acrylic resin to impart higher hardness.

To form acrylic resin from such polymerizable monomer, for example, a method of polymerizing through an electron beam or ultraviolet ray with addition of a photopolymerization initiator can be employed.

Examples of the photopolymerization initiator include radical-generating photopolymerization initiators such as benzophenone, thioxanthones, benzil dimethylketal, α-hydroxyketone, α-hydroxyalkylphenone, α-aminoketone, α-aminoalkylphenone, monoacylphosphine oxide, bisacylphosphine oxide, hydroxybenzophenone, aminobenzophenone, titanocenes, oxime esters and oxyphenylacetates.

To impart superior strength to the surface layer and to impart superior toner releasability to the outer surface of the surface layer, the content of the binder resin in the surface layer can be 20% by mass or more and 70% by mass or less with respect to the mass of the total solid content in the surface layer 32.

<PFPE>

The term "PFPE" refers to oligomer or polymer including a repeating unit of perfluoroalkylene ether.

Examples of the repeating unit of perfluoroalkylene ether include repeating units of perfluoromethylene ether, perfluoroethylene ether and perfluoropropylene ether. A commercially available PFPE can be used, such as "DEMNUM" (trade name; produced by DAIKIN INDUSTRIES, LTD.), "Krytox" (trade name; Du Pont) and "FOMBLIN" (trade name; Solvay Specialty Polymers).

The weight average molecular weight, Mw, of the PFPE can be 1000 or higher and 9000 or lower, in view of migration of the PFPE to the surface of the electrophotographic belt.

The weight average molecular weight herein is a value obtained from measurement of a solution of the PFPE dissolved in "ZEOROLA H" (trade name; produced by Zeon Corporation) by using a liquid chromatography analyzer (produced by Shimadzu Corporation).

The compound name of "ZEOROLAH" is 1,1,2,2,3,3,4-heptafluorocyclopentane.

The PFPE may have a reactive functional group being capable of forming a bond to or bond-like state with the binder resin, or a non-reactive functional group being incapable of forming a bond to or bond-like state with the binder resin.

If the PFPE has the reactive functional group, satisfactory compatibility between the binder resin and the PFPE is achieved through the interaction between the PFPE and the binder resin, and the PFPE is stably dispersed. In the case that the binder resin is formed through addition reaction, for example, examples of the reactive functional group to cause addition reaction with a monomer to form the binder resin include an acryl group, a methacryl group and an oxysilanyl group.

Examples of commercially available products of the PFPE having such a reactive functional group include "Fluorolink MD500", "Fluorolink MD700", "Fluorolink 5101X", "Fluorolink 5113X" and "Fluorolink AD1700" (trade name; all produced by Solvay); and "OPTOOL DAC" (trade name; produced by DAIKIN INDUSTRIES, LTD.).

"Fluorolink MD500" is a PFPE having a methacryl group as a functional group, and "Fluorolink AD1700" is a PFPE having an acryl group as a functional group.

In the case that the binder resin is formed through addition reaction, examples of the non-reactive functional group which does not undergo addition reaction with a monomer to form the binder resin include a hydroxy group, a trifluoromethyl group and a methyl group. Examples of commercially available products of the PFPE having such a non-reactive functional group include "Fluorolink D10H", "Fluorolink D4000" and "FOMBLIN Z15" (trade name; all produced by Solvay); and "DEMNUM S-20", "DEMNUM S-65" and "DEMNUM 5200" (trade name; all produced by DAIKIN INDUSTRIES, LTD.).

Among the PFPEs, PFPEs having a non-reactive functional group can be used in view of even higher tendency of the PFPE to migrate to the surface of the electrophotographic belt and achievement of even higher releasability for the surface of the electrophotographic belt.

The content of the PFPE in the surface layer can be 20% by mass or more and 40% by mass or less with respect to the mass of the total solid content in the surface layer.

When the content of the PFPE is adjusted in the range, the PFPE is fed from the inside of the surface layer of the electrophotographic belt to the surface of the electrophotographic belt, and as a result degradation of the releasability of the surface of the electrophotographic belt can be suppressed.

<Dispersant>

The dispersant functions as a dispersant to disperse the PFPE in the binder resin.

The dispersant is a comb-shaped graft copolymer being a copolymer of an acrylate or methacrylate having a fluoroalkyl group and a methacrylate macromonomer having a polymethyl methacrylate as a side chain.

In addition, the copolymer has a number average molecular weight, Mn, in the range of 11000 or higher and 15000 or lower, and a peak-top molecular weight, Mp, in the range of 24000 or higher and 40000 or lower, in order to disperse the PFPE in the binder resin.

Regarding the relation between use of such a dispersant and effects exerted by the electrophotographic belt according to the present aspect, the present inventors think as follows.

The fluoroalkyl group of the dispersant attaches to the PFPE. On the other hand, the portion derived from the acrylate or methacrylate and the portion derived from the methacrylate macromonomer having a polymethyl methacrylate as a side chain are under steric hindrance effect to inhibit aggregation with another PFPE.

By virtue of this steric hindrance effect, the dispersant exhibits superior dispersing performance for the PFPE.

In addition, the dispersant can develop high steric hindrance effect due to the number average molecular weight and peak-top molecular weight in the above-mentioned numerical ranges to effectively inhibit aggregation of the PFPE. Accordingly, the domain size of the PFPE in the binder resin can be a small size, for example, such that the average major axis is 1 nm or larger and 60 nm or smaller, and degradation of the glossiness of the surface of the electrophotographic belt can be prevented. In addition, the dispersant can prevent excessive reduction of the encounter probability for the dispersant and the PFPE by virtue of the number average molecular weight and peak-top molecular weight in the above-mentioned numerical ranges. Accordingly, the aggregation of the PFPE can be inhibited, and thus increase of the domain size can be prevented. As a result, degradation of the glossiness of the surface of the electrophotographic belt can be prevented.

Here, the number average molecular weight and peak-top molecular weight are each a value obtained from measurement by using a GPC apparatus.

Specifically, the dispersant is dissolved in tetrahydrofuran. The solution was injected into a column (trade name; TSK-GEL MULTIPORE HXL-M; produced by Tosoh Corporation) and allowed to pass through the column at a certain flow rate. The elution time distribution was determined by using a gel permeation chromatograph (HLC-8220 produced by Tosoh Corporation), which elutes components adsorbed by the column, and the molecular weight distribution is calculated from the result with reference to a calibration curve prepared in advance from a polystyrene standard having a known molecular weight. From the result, the number average molecular weight is calculated. The peak-top molecular weight is defined as the mode of the number average molecular weight distribution.

Here, the comb-shaped graft copolymer being a copolymer of an acrylate or methacrylate having a fluoroalkyl group and a methacrylate macromonomer having a polymethyl methacrylate as a side chain is commercially available. Examples of the commercially available product include "ARON GF-150", "ARON GF300", "ARON GF400" and "ARON GF420" (trade name; all produced by TOAGOSEI CO., LTD.).

By using any of these compounds and a method described below, the dispersant according to the present aspect having a number average molecular weight and peak-top molecular weight within the specified numerical ranges can be prepared.

Specifically, the dispersant according to the present aspect can be prepared through preparation of the comb-shaped graft copolymer by using a preparative HPLC apparatus (trade name: LC-908; Japan Analytical Industry Co., Ltd.). For the column, "JAIGEL-1H", "JAIGEL-2H", "JAIGEL-3H", "JAIGEL-4H" or "JAIGEL-5H" (trade name; all produced by Japan Analytical Industry Co., Ltd., diameter 20×600 mm: preparative column) can be used. Specifically, the dispersant is injected into a column, and the solution is collected at each elution time to obtain dispersants having different molecular weight distributions.

The molecular weight distribution of each solution is determined by using the GPC apparatus. From the separated solutions for which molecular distribution has been determined, a dispersant having a desired peak-top molecular weight, Mp, is selected. If the number average molecular weight of the separated solution for which the peak-top molecular weight, Mp, has been specified is higher than a desired number average molecular weight, Mn, the number average molecular weight, Mn, can be decreased, without causing change in peak-top molecular weight, Mp, through mixing with a separated solution with a lower molecular weight. If the number average molecular weight of the separated solution is lower than a desired number average molecular weight, Mn, the number average molecular weight, Mn, can be increased, without causing change in peak-top molecular weight, Mp, through mixing with a separated solution with a higher molecular weight.

Thus, the dispersant according to the present aspect can be obtained.

The content of the dispersant is preferably 5% by mass or more and 30% by mass or less, and more preferably 15% by mass or more and 25% by mass or less, with respect to the mass of the total solid content in the surface layer.

<Conductive Agent>

The electrophotographic belt can exhibit a comparable electrical resistance value even after the surface layer 32 is formed on the base layer 31. Accordingly, the surface layer 32 can be also semiconductive. Specifically, the volume resistivity of the electrophotographic belt can be adjusted in the range of 1E+8 [Ω·cm] or higher and 1E+12 [Ω·cm] or lower. In addition, the surface resistivity of the electrophotographic belt can be adjusted in the range of 1E+8 [Ω/□] or higher and 1E+14 [Ω/□] or lower. To adjust the volume resistivity and surface resistivity of the electrophotographic belt, the surface layer 32 can contain a conductive agent.

To impart conductivity, a conductive agent can be added to the surface layer 32. Examples of the conductive agent include inorganic conductive particles based on carbon such as carbon black, carbon fibers and carbon nanotubes, and metal oxides or the like such as zinc antimonate, zinc oxide, tin oxide and titanium oxide.

The surface layer 32 contains the above binder and PFPE, and the surface layer can have, in the thickness direction, a matrix-domain structure, and the average major axis of the domain can be 1 nm or larger and 60 nm or smaller.

<Matrix-Domain Structure>

The surface layer 32 has, in the thickness direction, a matrix-domain structure. The surface free energy of the PFPE is very low. Accordingly, the PFPE contained in the surface layer 32 of the electrophotographic belt can lower the adhesion of a toner to the surface of the surface layer 32. On the other hand, the property of very low surface free energy forces the PFPE to have a tendency to migrate to the interface between the surface layer 32 and the air, in other words, the outermost surface of the surface layer 32. That is, the PFPE has a tendency to be localized in the surface side of the surface layer 32.

In the present aspect, the PFPE having such a property is contained in the matrix resin constituting the surface layer 32 and present as a domain. As a result, the PFPE is randomly distributed in the thickness direction of the surface layer 32.

This indicates that the PFPE is in a state such that the PFPE is not limitedly present in the outermost surface of the surface layer 32 but present in the entire of the surface layer, and further indicates that the PFPE is in a state such that a large amount of the PFPE forming a domain is present. For this reason, even when the surface layer 32 of the electrophotographic belt has undergone various chemical and/or physical degradations to lose the PFPE in the surface, the domain of the PFPE present in the inside of the surface layer 32 is exposed in the surface of the surface layer 32. Accordingly, the PFPE can be steadily present in the surface of the surface layer 32. Probably because of this, the electrophotographic belt according to the present disclosure can maintain the satisfactory transfer properties.

This inference is supported by experimental results of surface analysis through X-ray photoelectron spectroscopy (XPS), the results showing that the electrophotographic belt according to the present aspect after being used for output of an image on many sheets exhibited a peak derived from the PFPE at a level comparative to the level for the initial state.

As described above, the surface layer 32 of the electrophotographic belt according to the present aspect has a matrix-domain structure in the thickness direction. Accordingly, the domain containing the PFPE is randomly distributed in the thickness direction of the surface layer 32, in other words, from the base layer 31 side to the outermost surface side of the surface layer 32.

In the surface layer having such a configuration, a domain positioned in the outermost surface side of the surface layer 32 is partially exposed in the surface, or becomes exposed in the earliest stage of image formation. As a result, the domain containing the PFPE is formed as spots in the matrix also in the surface of the surface layer 32. It is difficult for a toner to be immobilized onto such a surface including regions with different adhesion to a toner, and thus such a mode is preferred in view of maintaining satisfactory transfer properties.

In addition, a structure in which voids are present in a part of the PFPE domain exposed in the outermost surface of the surface layer 32 may be formed depending on the types and combination of components used in formation of the surface layer 32 such as the binder resin contained in the matrix, the PFPE, a solvent and the dispersant.

When concaves due to the presence of such voids are present as spots like islands in the outermost surface, the outermost surface is likely to be scraped by the physical action of frictional sliding caused by a cleaning blade or a paper sheet or the like. As a result, feeding of the PFPE from the PFPE domain as concaves is accelerated, and the PFPE domain present in the thickness direction is likely to appear in the outermost surface because the outermost surface is likely to be scraped. Accordingly, the action of the PFPE is effectively exhibited. Since the concaves result in a smaller contact area between the outermost surface and a toner, the adhesion force of a toner to the surface layer 32 is reduced. Primarily by virtue of these three actions, the structure in which voids are present in a part of the PFPE domain exposed in the outermost surface of the surface layer is a preferred mode, which is a structure which enables maintenance of satisfactory transfer properties. Alternatively, the geometrical effect described here can be exhibited through control of the geometry of the outermost surface by using physical surface processing such as nanoimprinting and wrapping.

In the matrix-domain structure, the average major axis of the domain is 1 nm or larger and 60 nm or smaller. Through setting the average major axis of the domain to 1 nm or larger, a matrix-domain structure is formed and the adhesion to a toner is kept low for a long period of time, and thus satisfactory transfer properties can be maintained. Through setting the average major axis of the domain to 60 nm or smaller, the surface glossiness can be maintained for a long period of time.

The average major axis of the domain can be determined by using a method described in Examples in the present specification.

Achievement of the effects of the electrophotographic belt according to the present aspect is difficult even when particles of polytetrafluoroethylene, which is another fluorine compound, are simply dispersed in the surface layer 32 of the electrophotographic belt. This is one of the reasons why the effect is inferred to be exhibited by the action of the PFPE.

Further, the domain can be substantially consisting only of the PFPE. However, a chemical species other than the PFPE may be present together with the PFPE in the domain in a manner such that the effects exerted by the electrophotographic belt according to the present aspect are exhibited. Alternatively, an additive compatible with the PFPE may be added for the purpose of adjustment of any other properties. Even in the case that the domain is not completely filled with the PFPE and voids are present, the above effects can be exhibited.

The domain containing the PFPE is phase-separated from the matrix containing the binder resin. Even when a matrix and a domain are phase-separated, however, the composition of the matrix and the composition of the domain are not strictly distinguishable in general. Even in the case that a matrix and a domain are phase-separated with a clear interface, each of the phases may contain a trace amount of a component from the other phase. Some academic study reports that an intermediate composition is present in a width as narrow as around 10 nm in the interface. In the present disclosure, the presence or absence of the matrix-domain structure can be confirmed through observation of a cross-section cut out in the thickness direction of the surface layer 32 of the electrophotographic belt under a scanning electron microscope (SEM).

On the other hand, the surface layer 32, for which a matrix-domain structure is observed in the thickness direction, has a tendency to form regions containing the PFPE which are present as spots like islands in the outermost surface, as described above. For this reason, when the outermost surface of the surface layer 32 is observed through SEM, a state in which regions containing the PFPE are present as spots like islands is often observed.

Whether the domain contains the PFPE can be determined through detection by using an elemental analysis method such as energy dispersive X-ray spectrometry (EDX), TOF-SIMS and Auger spectroscopy. For example, the domain in the electrophotographic belt was subjected to elemental analysis through EDX and the element fluorine was detected, from which the domain was determined to be a domain containing the PFPE. In addition, a fragment of a fluorocarbon ether structure derived from the PFPE was successfully observed from the domain through TOF-SIMS.

<Method for Producing Electrophotographic Belt>

Now, a specific method for producing the electrophotographic belt according to one aspect of the present disclosure will be described. It should be noted that the present disclosure is not limited to the production method below.

The base layer 31 of the electrophotographic belt can be prepared by using the following method.

In the case that a thermosetting resin such as polyimide is used, for example, carbon black as a conductive agent is dispersed together with a precursor of a thermosetting resin or a soluble thermosetting resin and a solvent to form a varnish, and a mold in a centrifugal molding apparatus is coated with the varnish. Then, the coating film is subjected to a calcination process to form a semiconductive film.

In the case that a thermoplastic resin is used, carbon black as a conductive agent and a thermoplastic resin, and, as necessary, an additional additive are mixed together, and melt-kneaded by using a twin-screw kneader or the like to prepare a semiconductive resin composition. Subsequently, the resin composition is subjected to an extrusion method to extrude into a sheet, a film or an endless belt through melt extrusion, and thus a semiconductive film can be obtained. The base layer in a shape of an endless belt can be produced by using a method of extrusion molding with a cylindrical die or a method of jointing sheets formed through extrusion to form a shape of an endless belt. Alternatively, a shape of an endless belt can be formed through heat press or injection molding. The thickness of the semiconductive film to serve as the base layer 31 can be 30 μm or larger and 150 μm or smaller.

The semiconductive film to serve as the base layer 31 can be subjected to crystallization treatment for the purpose of enhancement of the mechanical strength and endurance strength of the electrophotographic belt. Examples of the crystallization treatment include a method of annealing a resin to be used at a temperature equal to or higher than the glass transition temperature of the resin to accelerate the crystallization of the resin. The electrophotographic belt obtained in this manner is superior not only in mechanical strength and endurance strength, but also in the aspects of abrasion resistance, chemical resistance, slidability, toughness and flame retardance.

Examples of the method for forming the surface layer 32 of the electrophotographic belt include the following method. First, the polymerizable monomer, polymerization initiator, PFPE, dispersant and conductive agent for formation of the binder resin as the above-described member constituting the surface layer 32 are dissolved and dispersed in an appropriate organic solvent to obtain a coating solution for the surface layer. Subsequently, the coating solution is applied to the outer periphery of the base layer 31 through ring coating, dip coating, spray coating or any other coating method, and dried at 60 to 90° C. for the purpose of removal of the organic solvent. Thereafter, the coating solution is UV-cured by using a UV irradiation apparatus to afford the electrophotographic belt.

The thickness of the surface layer 32 can be 1 μm or larger and 20 μm or smaller. Through setting the thickness of the surface layer 32 to 1 μm or larger, required durability can be ensured. Through setting the thickness of the surface layer 32 to 20 μm or smaller, required bending resistance performance can be achieved.

According to one aspect of the present disclosure, an electrophotographic belt being capable of forming satisfactory electrophotographic images for a long period of time can be obtained.

EXAMPLES

First, methods for measuring the physical properties of an electrophotographic belt will be described.

<Glossiness Measurement>

In measurement of the glossiness of the surface of an electrophotographic belt, the glossiness of a central portion in the width direction of an electrophotographic belt was measured at 20 points positioned at regular intervals in the circumferential direction of the electrophotographic belt.

In measurement of glossiness, a handy gross meter (trade name: PG-IIM; produced by NIPPON DENSHOKU INDUSTRIES CO., LTD.) was used, and an incidence angle of 20° was selected. The arithmetic average of measurements at the 20 points was used as the glossiness of an electrophotographic belt for measurement.

<Average Domain Major Axis>

For the average domain major axis, a cross-section of the surface layer 32 of an electrophotographic belt was observed by using a scanning electron microscope (S-4800 produced by Hitachi High-Technologies Corporation). First, cross-sections of the surface layer 32 of an electrophotographic belt were cut out for use as samples by using a microtome (produced by Leica Microsystems GmbH, trade name: EM UC7). Among the cross-sections, an SEM image of a cross-section for which at least one or more domains were observable per unit area of 15 μm' at a magnification of 20000× was used. In the case that the number of domains was 10 or less, the major axes of all domains in the field of view were measured. In the case that the number of domains was more than 10, 10 domains were randomly selected, and the major axes of the selected domains were measured. Aforementioned measurement were repeated 10 times at different positions in the cross-section, and an arithmetic average value of the major axes of 100 domains total measured in the ten of respective SEM images of the cross-section was defined as the average major axis of the domain in each of the following examples and comparative examples.

<Image Evaluation—Evaluation of Transfer Properties>

An electrophotographic belt in Example or Comparative Example was installed in a full-color electrophotographic image forming apparatus (trade name: iRC2620; produced by Canon Inc.) in place of an intermediate transfer belt originally installed therein, and printing was performed. Then, images immediately after initiation of printing and images after printing on 100000 sheets (100000 cycles of repeated transfer) were visually observed, and evaluated by using the following criteria.

rank A: degradation of image quality due to transfer failure was not found.

rank B: little degradation of image quality due to transfer failure was found.

rank C: degradation of image quality due to transfer failure was generated, and the fraction was 50% or less of the printed area.

rank D: degradation of image quality due to transfer failure was totally generated.

<Image Evaluation—Evaluation of Unevenness in Concentration>

In the same manner as the evaluation of transfer properties, an electrophotographic belt in Example or Comparative Example was installed in a electrophotographic image forming apparatus (trade name: iRC2620; produced by Canon Inc.) in place of a polyimide intermediate transfer belt originally installed therein, and images were formed on 100000 sheets.

The image on the first sheet and the image on the 100000th sheet were visually observed, and evaluation was performed with respect to the presence or absence of difference of image concentration for the 100000th sheet from image concentration for the first sheet, and the degree of concentration difference, if the concentration difference was found, by using the following criteria.

rank A: no concentration difference was found as compared with the image on the first sheet.

rank B: slight concentration difference was found as compared with the image on the first sheet.

rank C: clear concentration difference was found as compared with the image on the first sheet.

Example 1

<Preparation of Dispersion for Formation of Surface Layer>

The materials below were mixed and dispersed by using a stirring homogenizer (produced by AS ONE Corporation), and dispersion was performed by using a disperser (trade name: Nanomizer; produced by YOSHIDA KIKAI CO., LTD.) to afford a dispersion for formation of the surface layer.

Dipentaerythritol hexaacrylate (DPHA): 7.0 parts by mass
Pentaerythritol tetraacrylate (PETTA): 15.0 parts by mass
Pentaerythritol triacrylate (PETA): 4.4 parts by mass
Methyl ethyl ketone: 26.4 parts by mass Antimony-doped tin oxide fine particle (trade name: SN-100P; produced by ISHIHARA SANGYO KAISHA, LTD.): 4.5 parts by mass
Photopolymerization initiator 1 (trade name: OMNIRAD4; IGM Resins): 2.0 parts by mass
PFPE 1 (trade name: Fluorolink MD700 (produced by Solvay Specialty Polymers): 14.8 parts by mass
Dispersant 1 (trade name: ARON GF-420; produced by TOAGOSEI CO., LTD., fractionated product, Mp: 24200, Mn: 11000, solid content concentration: 35% by mass): 25.9 parts by mass <Production of Electrophotographic Belt>

A polyimide intermediate transfer belt originally installed in a color electrophotographic image forming apparatus (trade name: iRC2620; produced by Canon Inc.) was used as the base layer 31. The outer peripheral surface of the base layer 31 was coated with the dispersion prepared in the above, and the dispersion was dried at a temperature of 70° C. for 3 minutes to form a coating film of the dispersion.

Then, the coating film was irradiated with an ultraviolet ray of 500 mJ/cm$^2$ by using an UV treatment apparatus (produced by EYE GRAPHICS CO., LTD.) for curing to form a surface layer with a film thickness of 4 μm, and thus an electrophotographic belt 1 was obtained.

The type, amount added and molecular weight of PFPE used, and the type, amount added and molecular weight of a dispersant used are shown in Table 1.

For the electrophotographic belt 1 obtained, the glossiness measurement, domain major axis measurement, image evaluation—evaluation of transfer properties and image evaluation—evaluation of unevenness in concentration were performed. The results are shown in Table 2. The amount of PFPE added and amount of a dispersant added were each represented in terms of a content in the total solid content. The total solid content was calculated by excluding methyl ethyl ketone as a solvent and the solvent component of a dispersant from the components of the composition.

Example 2

An electrophotographic belt 2 was produced in the same manner as in Example 1 except that the dispersant 1 was replaced with a dispersant 2 (trade name: ARON GF-420; produced by TOAGOSEI CO., LTD., fractionated product, Mp: 40000, Mn: 13000, solid content concentration: 35% by mass) differing from the dispersant 1 in elution time.

Example 3

An electrophotographic belt 3 was produced in the same manner as in Example 1 except that the dispersant 1 in Example 1 was replaced with a dispersant 3 (trade name: ARON GF-420; produced by TOAGOSEI CO., LTD., fractionated product, Mp: 24200, Mn: 15000, solid content concentration: 35% by mass) differing from the dispersant 1 in elution time.

Example 4

An electrophotographic belt 4 was produced in the same manner as in Example 1 except that the formulation of the dispersion for formation of the surface layer was changed as follows.
DPEH: 7.7 parts by mass
PETA: 16.3 parts by mass
PETRA: 4.8 parts by mass
Methyl ethyl ketone: 28.8 parts by mass
Antimony-doped tin oxide fine particle (trade name: SN-100P; produced by ISHIHARA SANGYO KAISHA, LTD.): 4.4 parts by mass
Photopolymerization initiator 1: 1.9 parts by mass
PFPE 1: 11.0 parts by mass
Dispersant 1: 25.1 parts by mass Example 5

An electrophotographic belt 5 was produced in the same manner as in Example 1 except that the formulation of the dispersion for formation of the surface layer was changed as follows.
DPEH: 5.5 parts by mass
PETA: 11.8 parts by mass
PETRA: 3.5 parts by mass
Methyl ethyl ketone: 20.8 parts by mass
Antimony-doped tin oxide fine particle (trade name: SN-100P; produced by ISHIHARA SANGYO KAISHA, LTD.): 5.0 parts by mass
Photopolymerization initiator 1: 2.2 parts by mass
PFPE 1: 24.8 parts by mass
Dispersant 1: 26.6 parts by mass Example 6

An electrophotographic belt 6 was produced in the same manner as in Example 1 except that the formulation of the dispersion for formation of the surface layer was changed as follows.
DPEH: 5.4 parts by mass
PETA: 11.6 parts by mass
PETRA: 3.4 parts by mass
Methyl ethyl ketone: 20.4 parts by mass
Antimony-doped tin oxide fine particle (trade name: SN-100P; produced by ISHIHARA SANGYO KAISHA, LTD.): 4.3 parts by mass
Photopolymerization initiator 1: 1.9 parts by mass
PFPE 1: 14.1 parts by mass
Dispersant 1: 38.8 parts by mass Example 7

An electrophotographic belt 7 was produced in the same manner as in Example 1 except that the formulation of the dispersion for formation of the surface layer was changed as follows.
DPEH: 7.2 parts by mass
PETA: 15.3 parts by mass
PETRA: 4.5 parts by mass
Methyl ethyl ketone: 27.1 parts by mass
Antimony-doped tin oxide fine particle (trade name: SN-100P; produced by ISHIHARA SANGYO KAISHA, LTD.): 4.6 parts by mass
Photopolymerization initiator 1: 2.0 parts by mass
PFPE 1: 14.8 parts by mass
Dispersant 1: 24.4 parts by mass Example 8

An electrophotographic belt 8 was produced in the same manner as in Example 1 except that the PFPE 1 was replaced with a PFPE 2 (trade name: Fluorolink D10H; produced by Solvay Specialty Polymers) in Example 1.

Example 9

An electrophotographic belt 9 was produced in the same manner as in Example 1 except that the PFPE 1 was replaced with a PFPE 3 (trade name: FOMBLIN MD40; produced by Solvay Specialty Polymers) in Example 1.

Example 10

An electrophotographic belt 10 was produced in the same manner as in Example 1 except that the PFPE 1 was replaced with a PFPE 4 (trade name: Fluorolink MD500; produced by Solvay Specialty Polymers) in Example 1.

Example 11

An electrophotographic belt 11 was produced in the same manner as in Example 4 except that the PFPE 1 was replaced with the PFPE 2 in Example 4.

Example 12

An electrophotographic belt 12 was produced in the same manner as in Example 5 except that the PFPE 1 was replaced with the PFPE 2 in Example 5.

The type, amount added and molecular weight of PFPE, and the type, amount added and molecular weight of a dispersant used for formation of the surface layer of each of the electrophotographic belts 1 to 12 according to Examples 1 to 12 are shown in Table 1.

For the electrophotographic belts 1 to 12, the glossiness measurement, domain major axis measurement, image evaluation—evaluation of transfer properties and image evaluation—evaluation of unevenness in concentration were performed. The results are shown in Table 2.

The amount of PFPE added and amount of a dispersant added in Table 1 were each represented as a content in the total solid content. The total solid content was calculated by excluding methyl ethyl ketone as a solvent and the solvent component of a dispersant from the components of the composition.

Comparative Example 1

An electrophotographic belt 21 was produced in the same manner as in Example 1 except that the dispersant 1 was replaced with a dispersant 4 ("ARON GF-420" (trade name; produced by TOAGOSEI CO., LTD.) before fractionation) in Example 1.

Comparative Example 2

An electrophotographic belt 22 was produced in the same manner as in Example 1 except that the dispersant 1 was replaced with a dispersant 5 ("ARON GF-420" (trade name: produced by TOAGOSEI CO., LTD., fractionated product, Mp: 45000, Mn: 14000, solid content concentration: 35%)) differing from the dispersant 1 in elution time in Example 1.

Comparative Example 3

An electrophotographic belt 23 was produced in the same manner as in Example 1 except that the dispersant 1 was replaced with a dispersant 6 ("ARON GF-420", produced by TOAGOSEI CO., LTD., fractionated product, Mp: 25000, Mn: 9300, solid content concentration: 35%) differing from the dispersant 1 in elution time in Example 1.

Comparative Example 4

An electrophotographic belt 24 was produced in the same manner as in Example 1 except that the dispersant 1 was replaced with a dispersant 7 ("ARON GF-420", produced by TOAGOSEI CO., LTD., fractionated product, Mp: 25000, Mn: 17000, solid content concentration: 35%) differing from the dispersant 1 in elution time in Example 1.

Comparative Example 5

An electrophotographic belt 25 was produced in the same manner as in Example 1 except that the dispersant 1 was replaced with a dispersant 8 (ARON® GF-300, produced by TOAGOSEI CO., LTD.) in Example 1.

Evaluation was performed for the electrophotographic belts 21 to 25 produced in Comparative Examples 1 to 5 in the same manner as in Example 1. The type, amount added and molecular weight of PFPE, and the type, amount added and molecular weight of a dispersant used for formation of the surface layer in each of Comparative Examples 1 to 5 are shown in Table 1, and the evaluation results are shown in Table 2.

TABLE 1

| | | | PFPE | | | Dispersant | | | |
|---|---|---|---|---|---|---|---|---|---|
| | | Electrophotographic belt No. | Type | Mw | Amount added (% by mass) | No. | Mp | Mn | Amount added (% by mass) |
| Example | 1 | 1 | PFPE1 | 1700 | 26.1 | dispersant 1 | 24200 | 11000 | 16.0 |
| | 2 | 2 | PFPE1 | 1700 | 26.1 | dispersant 2 | 40000 | 13000 | 16.0 |
| | 3 | 3 | PFPE1 | 1700 | 26.1 | dispersant 3 | 24200 | 15000 | 16.0 |
| | 4 | 4 | PFPE1 | 1700 | 20.0 | dispersant 1 | 24200 | 11000 | 16.0 |
| | 5 | 5 | PFPE1 | 1700 | 39.9 | dispersant 1 | 24200 | 11000 | 15.0 |
| | 6 | 6 | PFPE1 | 1700 | 26.0 | dispersant 1 | 24200 | 11000 | 25.0 |
| | 7 | 7 | PFPE1 | 1700 | 26.0 | dispersant 1 | 24200 | 11000 | 15.0 |
| | 8 | 8 | PFPE2 | 1600 | 26.1 | dispersant 1 | 24200 | 11000 | 16.0 |
| | 9 | 9 | PFPE3 | 4000 | 26.1 | dispersant 1 | 24200 | 11000 | 16.0 |
| | 10 | 10 | PFPE4 | 1700 | 26.1 | dispersant 1 | 24200 | 11000 | 16.0 |
| | 11 | 11 | PFPE2 | 1600 | 20.0 | dispersant 1 | 24200 | 11000 | 16.0 |
| | 12 | 12 | PFPE2 | 1600 | 39.9 | dispersant 1 | 24200 | 11000 | 15.0 |
| Comparative Example | 1 | 21 | PFPE1 | 1700 | 26.1 | dispersant 4 | 21000 | 6500 | 16.0 |
| | 2 | 22 | PFPE1 | 1700 | 26.1 | dispersant 5 | 45000 | 14000 | 16.0 |
| | 3 | 23 | PFPE1 | 1700 | 26.1 | dispersant 6 | 25000 | 9300 | 16.0 |
| | 4 | 24 | PFPE1 | 1700 | 26.1 | dispersant 7 | 25000 | 17000 | 16.0 |
| | 5 | 25 | PFPE1 | 1700 | 26.1 | dispersant 8 | 8000 | 5000 | 16.0 |

TABLE 2

| | | | Physical properties of surface layer | | | Rank in image evaluation | | | |
|---|---|---|---|---|---|---|---|---|---|
| | | | | | | | | Evaluation of unevenness in concentration | |
| | | Electrophotographic belt No. | Domain Major axis (nm) | 20° glossiness (gloss) Initial | 20° glossiness (gloss) After 100k | Evaluation of transfer properties Initial | Evaluation of transfer properties After 100k | Initial | After 100k |
| Example | 1 | 1 | 20 | 84 | 64 | A | A | A | A |
| | 2 | 2 | 60 | 81 | 61 | A | A | A | A |
| | 3 | 3 | 30 | 83 | 63 | A | A | A | A |
| | 4 | 4 | 40 | 85 | 67 | B | B | A | A |
| | 5 | 5 | 40 | 81 | 60 | A | A | A | A |
| | 6 | 6 | 20 | 84 | 64 | A | A | A | A |
| | 7 | 7 | 50 | 81 | 61 | A | A | A | A |
| | 8 | 8 | 30 | 83 | 64 | A | A | A | A |
| | 9 | 9 | 30 | 83 | 65 | B | B | A | A |
| | 10 | 10 | 50 | 82 | 63 | A | A | A | A |
| | 11 | 11 | 50 | 81 | 63 | B | B | A | A |
| | 12 | 12 | 40 | 83 | 62 | A | A | A | A |
| Comparative Example | 1 | 21 | 300 | 62 | 42 | A | A | B | C |
| | 2 | 22 | 150 | 70 | 49 | A | A | A | C |
| | 3 | 23 | 180 | 71 | 49 | A | A | A | C |
| | 4 | 24 | 250 | 67 | 43 | A | A | A | C |
| | 5 | 25 | 350 | 58 | 37 | A | A | B | C |

The surface layer of each of the electrophotographic belts according to Examples 1 to 12 had a matrix-domain structure in the thickness direction, and the average major axis of the domain was 1 nm or larger and 60 nm or smaller. In addition, the 20° glossiness of the surface was high. As a result, almost no degradation of image quality due to transfer failure caused by an intermediate transfer belt was found for electrophotographic images formed by using each of the electrophotographic belts as an intermediate transfer belt, and unevenness in concentration was not found among images. In addition, these performances were maintained for a long period of time.

The surface layer of each of the electrophotographic belts according to Comparative Examples 1 to 5 had a matrix-domain structure in the thickness direction. However, the average major axis of the domain largely exceeded the upper limit (60 nm) specified in the present disclosure. The 20° glossiness of the surface was lower than 20° glossiness of the surface of each of the electrophotographic belts according to Examples 1 to 12. As a result, when the electrophotographic belts according to Comparative Examples 1 to 5 were used as an intermediate transfer belt, performances associated with unevenness in concentration among images could not maintained for a long period of time.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127526, filed Jun. 29, 2017, and Japanese Patent Application No. 2018-110459, filed Jun. 8, 2018, which are hereby incorporated by reference herein in their entirety.

What is claimed is:

1. An electrophotographic belt, comprising:

a base layer; and a surface layer, the surface layer comprising a binder resin, a perfluoropolyether and a comb-shaped graft copolymer, wherein the comb-shaped graft copolymer is a copolymer of an acrylate or methacrylate having a fluoroalkyl group, and a methacrylate macromonomer having a polymethyl methacrylate as a side chain, the comb-shaped graft copolymer has a number average molecular weight of 11000 to 15000, and the comb-shaped graft copolymer has a peak-top molecular weight of 24000 to 40000.

2. The electrophotographic belt according to claim 1, wherein the binder resin is an acrylic resin.

3. The electrophotographic belt according to claim 1, wherein the surface layer contains the perfluoropolyether in a content of 20 to 40% by mass with respect to the total solid content of the surface layer.

4. The electrophotographic belt according of claim 1, wherein the perfluoropolyether has a weight average molecular weight of 1000 to 9000.

5. The electrophotographic belt according of claim 1, wherein the perfluoropolyether has at least one member selected from the group consisting of a hydroxy group, a trifluoromethyl group and a methyl group.

6. The electrophotographic belt according to claim 1, wherein the content of the comb-shaped graft copolymer in the surface layer is 5 to 30% by mass with respect to the total solid content of the surface layer.

7. The electrophotographic belt according to claim 1, wherein the surface layer has, in the thickness direction, a matrix-domain structure comprising a matrix comprising the binder resin and a domain comprising the perfluoropolyether, and the average major axis of the domain is 1 to 60 nm.

8. An electrophotographic image forming apparatus comprising an electrophotographic belt, the electrophotographic belt comprising a base layer and a surface layer, the surface layer comprising a binder resin, a perfluoropolyether and a comb-shaped graft copolymer, wherein the comb-shaped graft copolymer is a copolymer of an acrylate or methacrylate having a fluoroalkyl group, and a methacrylate macromonomer having a polymethyl methacrylate as a side chain, the comb-shaped graft copolymer has a number average molecular weight of 11000 to 15000, and the comb-shaped graft copolymer has a peak-top molecular weight of 24000 to 40000.

9. The electrophotographic image forming apparatus according to claim 8, wherein the electrophotographic belt serves as an intermediate transfer belt.

* * * * *